US007207490B2

(12) United States Patent
Schneider

(10) Patent No.: US 7,207,490 B2
(45) Date of Patent: Apr. 24, 2007

(54) SECURITY ELEMENT

(75) Inventor: Walter Schneider, Miesbach (DE)

(73) Assignee: Giesecke & Devrient GmbH, Munich (DE)

( * ) Notice: Subject to any disclaimer, the term of this patent is extended or adjusted under 35 U.S.C. 154(b) by 143 days.

(21) Appl. No.: 10/508,972

(22) PCT Filed: Mar. 24, 2003

(86) PCT No.: PCT/EP03/03059

§ 371 (c)(1),
(2), (4) Date: Jun. 15, 2005

(87) PCT Pub. No.: WO03/080365

PCT Pub. Date: Oct. 2, 2003

(65) Prior Publication Data

US 2005/0237576 A1 Oct. 27, 2005

(51) Int. Cl.
*G06K 7/10* (2006.01)

(52) U.S. Cl. ..... 235/462.01; 235/494

(58) Field of Classification Search ..... 235/462.01, 235/494

See application file for complete search history.

(56) References Cited

U.S. PATENT DOCUMENTS 5,388,862 A * 2/1995 Edwards ..... 283/82
5,606,609 A * 2/1997 Houser et al. ..... 713/179
6,141,441 A * 10/2000 Cass et al. ..... 382/166
6,892,947 B1 * 5/2005 Jam et al. ..... 235/462.01
6,948,068 B2 * 9/2005 Lawandy et al. ..... 713/176
7,049,267 B2 * 5/2006 Wagner et al. ..... 503/200
7,114,657 B2 * 10/2006 Auslander et al. ..... 235/491

FOREIGN PATENT DOCUMENTS

| | | | |
|---|---|---|---|
| DE | 2 319 891 | | 11/1973 |
| DE | 3 034 916 | | 4/1981 |
| EP | 0 509 916 | A1 | 10/1992 |
| JP | 02001030568 | * | 2/2001 |
| NL | 8 603 064 | | 7/1988 |
| WO | WO 00 44571 | | 8/2000 |
| WO | WO 01 86579 | | 11/2001 |

OTHER PUBLICATIONS

De Heij et al. (EP 1 273 461 A2), Series of security documents provided with a watermark in the form of a bar code, Jan. 8, 2003, European Patent Application.*

* cited by examiner

*Primary Examiner*—Kimberly D. Nguyen
(74) *Attorney, Agent, or Firm*—Rothwell, Figg, Ernst & Manbeck, PC

(57) ABSTRACT

A bar code is integrated in the paper in the form of a watermark. The fields (6) which separate the information-conveying bars of the bar code from each other are formed as watermarks. The information-conveying bars can be formed as watermarks, but they do not have to. Their width results from the spacing of the separating fields (6). The separating fields (6) are more narrow than the information-conveying bars, as a result of which the total length of the bar code is kept short.

29 Claims, 3 Drawing Sheets

State of the Art

State of the Art

State of the Art

SECURITY ELEMENT

This application is a National Phase of PCT Application Serial No. PCT/EP03/03059, filed Mar. 24, 2003.

FIELD OF THE INVENTION

The invention relates to a security element, namely a bar code in the form of a watermark, as well as a security paper and a document of value or security document manufactured thereof, such as for example bank note, check, share, identity card, ticket for public transport, admission ticket and the like, with such a bar code, and furthermore a method and a papermaking screen for manufacturing the security paper.

BACKGROUND OF THE INVENTION

It is known to incorporate a bar code in a paper in the fashion of a watermark, in particular in a security paper, for manufacturing security documents or documents of value. For example, the authenticity of bank notes can be tested with reference to the bar code, if all bank notes of a certain value and a certain date of issue bear a certain watermark in the same fashion. By comparing with the serial number and the denomination printed on the bank note then the authenticity of the bank note can be checked with reference to the bar code. Depending on the complexity of the information encoded in the watermark bar code, the bar code can become comparatively long, which is undesirable with small dimensioned documents of value, such as for example bank notes.

The problem, however, is not only the length of the bar code, but in particular its checkability for the purpose of determining the authenticity. Because the broader the bars incorporated as a watermark in the paper, the more irregular is their appearance on transmissive viewing. The reason for this is that a watermark with a regular dark surface can be realized only with difficulties. For manufacturing the watermark the papermaking screen is embossed, so that the deposit of paper fiber during the sheet formation is influenced. If the papermaking screen is deep-embossed, more paper pulp deposits in this area, while a high-embossing impedes the deposit of paper pulp. With an embossed surface above all the edges of the surface are reproduced well. The surface itself towards its inner area becomes either lighter or darker.

SUMMARY OF THE INVENTION

It is the problem of the present invention to propose a bar code in the form of a watermark, which is more versatile and comparatively space-saving. A further problem of the invention is to provide a security paper equipped with such a bar code and papers of value or security documents manufactured thereof, as well as a method and a papermaking screen for manufacturing the security paper.

These problems are solved by a bar code, a security paper, a security document, a method and a papermaking screen according to the present invention.

Accordingly, the separating fields, through which the information-conveying bars are separated from each other, are formed as uniquely detectable watermarks. These separating fields are detected as (separating-field) bars by the bar-code reader. The actual bar code information, however, is not determined by the width of the detected (separating-field) bars but by the width of the fields located in between the detected (separating-field) bars, these fields representing the actual bars of the bar code. I.e., beginning and end of the information-conveying bars are each marked by the separating-field bars.

This offers the two following substantial advantages compared to prior art. Firstly, the information-conveying bars of the bar code located between the separating fields can be selected in any width. Since the lightness of the information-conveying bars is not taken into account when evaluating, there exist no problems with an irregularly filled bar surface appearing dark or light in transmitted light. Secondly, the separating fields can be formed extra narrow, in particular by using electrotypes on the papermaking screen, as a result of which the total length of the bar code is comparatively short and space-saving.

As to further reduce the length of the bar code, it is advantageous to form the bar code as a two-dimensional bar code, which has several e.g. parallel information tracks.

A particularly advantageous embodiment of the invention provides that the fields located between the separating fields, which form the actually information-conveying bars of the bar code, are not designed as a watermark, so that in transmitted light only the separating fields can be recognized as watermark bars. The first and the last separating field define the boundaries of the bar code.

As to increase the contrast, the information-conveying bars of the bar code, too, can have the design of a watermark, the separating fields being formed as light watermarks and the information-conveying bars as dark watermarks—or vice versa—. It is preferred that not the information-conveying bars are formed as light watermarks but the separating fields, since otherwise with light information-conveying bars at increasing width of the bars there would exist a danger of formation of holes in the paper.

According to a special embodiment of the invention a separating field located at the edge of the bar code, which means a first or last separating filed, for example by means of its characteristic width or its fiber density defines the information content to be assigned to the bars of different width, i.e. whether a broad bar indicates a "1" and a narrow bar a "0" or vice versa. Alternatively, the first bar can be defined as a startbit and its width can indicate, whether a broad bar of the bar code indicates "1" and a narrow bar "0" or vice versa.

According to a preferred embodiment, an inventive security document or document of value is equipped with an additional storage medium. This can be for example a magnetic storage medium, such as a magnetic track, or an electronic storage medium, such as a microchip with integrated circuits. With such an embodiment the bar code can contain data for encoding and decoding of information instead of the value of the document. In the storage medium can be stored in an advantageous fashion the document value rendered by the bar code together with the serial number of the document, or for example the result of a predetermined combining of the value factor and serial number. With that the forgery-proofness and the checkability of the authenticity of a document is increased. The storage of the combining in the additional storage medium can be effected when manufacturing the document or at the time of bringing it into circulation. When testing the authenticity the result of the combining can be read from the storage medium. If the way of combining is known, together with the document value which very easily can be read out from the bar code watermark, the serial number can be reconstructed. If in addition the serial number is read directly from the document, a further possibility arises for checking whether a read-out storage medium really belongs to an individual document such as for example a bank note.

Furthermore, coincidences in the formation of the inventive bar code, such as the cloudiness of the paper in the bar code area or irregularities in the run of the edge of individual sections, can be used as an additional measured value, so as to increase the forgery-proofness of a document or to improve the authenticity testing.

BRIEF DESCRIPTION OF THE DRAWINGS

In the following the invention is described by way of example with reference to the accompanying figures.

DETAILED DESCRIPTION OF THE INVENTION

Figure 1:
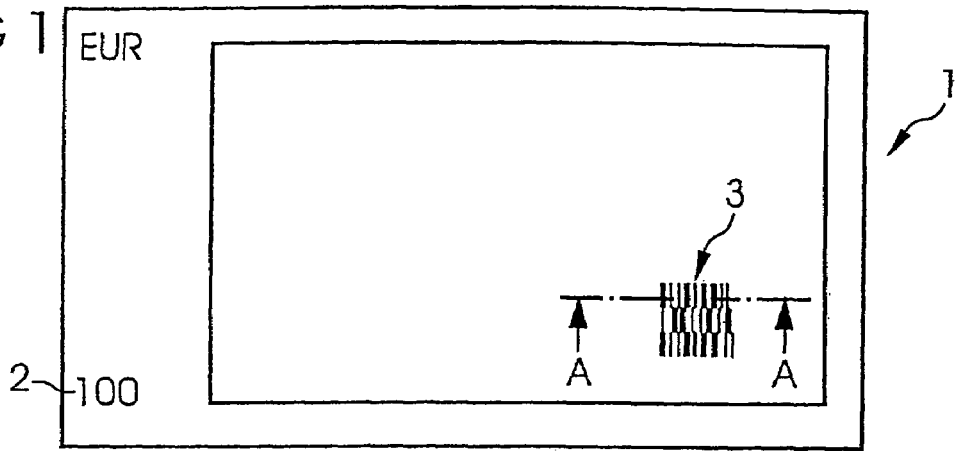
FIG. 1 shows a bank note with an inventive watermark bar code.

FIG. 1 shows in an exemplary fashion as one of many possible documents of value and security documents a bank note 1 with the denomination 2 of "EUR 100". The bank note 1 has a two-dimensional bar code 3, which is integrated in the fashion of a watermark in the security paper, out of which the bank note 1 is manufactured.

Figure 8:
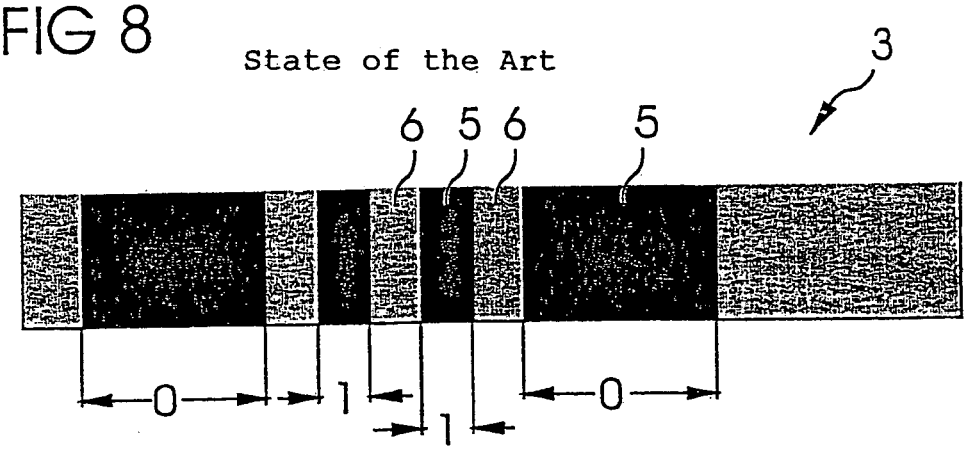
FIG. 8 shows a transmitted light view of a watermark bar code according to prior art.
Figure 9:
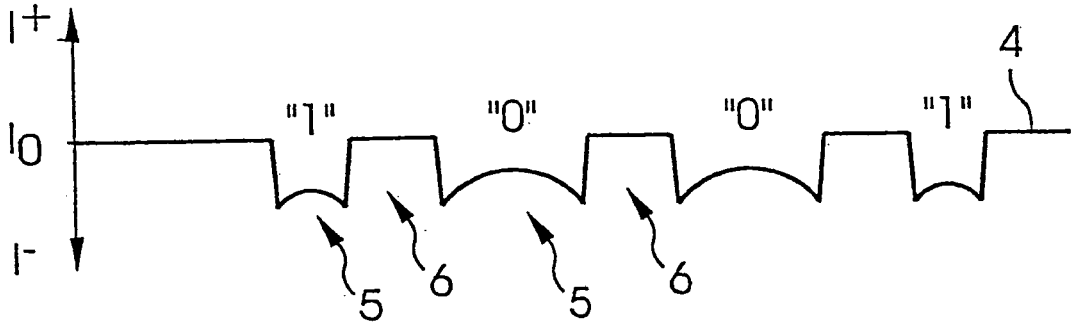
FIG. 9 shows a transmitted light intensity curve of a watermark bar code according to prior art.

Documents of value with a one-dimensional bar code in the form of a watermark are already known from prior art. The broader the bars incorporated in the paper as a watermark, the more irregular their appearance in transmitted light, so that the evaluation of the bars is very problematic. This is shown in FIG. 8, which schematically shows a watermark bar code 3 viewed in transmitted light. The bar code 3 was produced with an embossed papermaking screen, which in its embossed areas producing the bars 5 of the bar code 3 promotes the deposit of paper fiber. However, the fiber density i.e. the paper thickness, decreases towards the inner areas of the surface of the bar, so that the edge area of the surface can be imaged well, but the inner areas of the surface in transmitted light appear lighter vis-a-vis the edge areas. This is graphically shown in FIG. 9, where the transmitted light intensity $I^+$, $I^-$ deviating from a normal transmitted light intensity $I_0$ is plotted. It can be recognized that the transmitted light intensity I in the center of the bars comes the closer to the normal transmitted light intensity $I_0$ the broader the bar is. Here it has to be taken into account that the normal transmitted light intensity value $I_0$ in FIG. 9 is shown in an idealized way. Actually, this value $I_0$ varies about an average value, so that with broad bars it can occur that a bar code sensor signalizes the end of a bar 5 or the beginning of a separating field 6, although not more than the middle of the bar 5 has been reached. This can lead to read errors, because a broad bar 5 may be interpreted as two short bars by mistake.

The alternative, to use a light bar code instead of a dark bar code, has the same disadvantage, namely that the fiber density decreases towards the middle of the bar. Again the result is not a regularly light bar of the desired dimension. Furthermore, with broad bars there exists the danger of formation of holes in the paper.

Figure 10:
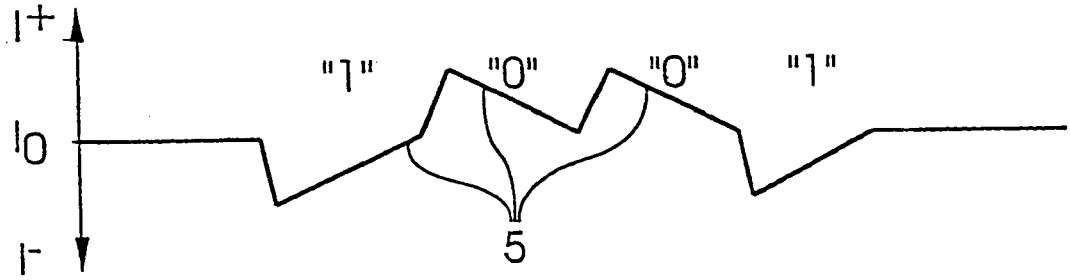
FIG. 10 shows a transmitted light intensity curve of a watermark bar code according to a further prior art.

In FIG. 10 is shown the transmitted light intensity I of a bar code known from DE 30 34 916 A1, where the problems described above do not arise. According to this the areas of the papermaking screen used for producing the bars of the bar code are embossed as rectangular, not isosceles triangles in the papermaking screen. The part of the watermark, which is produced by means of the steep edge in the paper, in transmitted light is easily recognizable as distinctive dark or light stripe and marks the beginning of a bar 5. Whether the bar 5 represents "1" or "0", does not depend on its width but on the fact, whether the bar is light or dark, which means whether the embossing of the papermaking screen starting from the level of the papermaking screen is directed downwards or upwards. As a result of this also the length of the whole bar code can be kept short, because separating fields 6 between the individual bars 5 for the clear delimitation from each other can be omitted. Disadvantageous, however, is the fact, that the bar code is restricted to a digital encoding, because only light and dark fields are differentiated.

Figure 2:
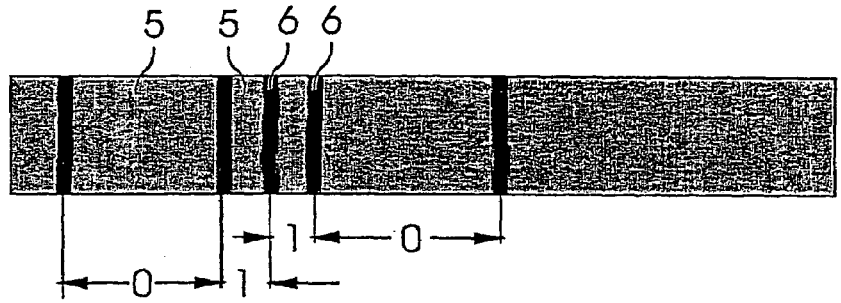
FIG. 2 shows a transmitted light view of an inventive watermark bar code.
Figure 3:
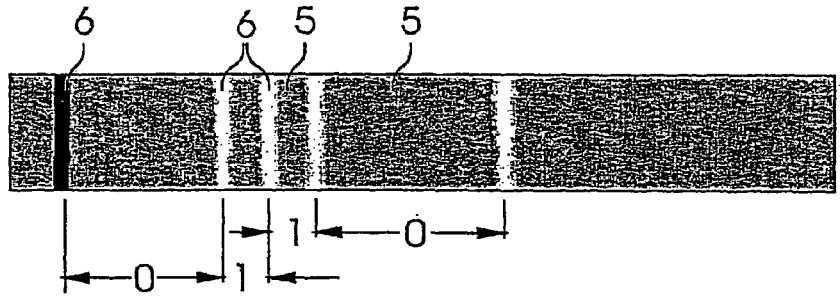
FIG. 3 shows a transmitted light view of a further inventive watermark bar code, FIG. 4 schematically shows a papermaking screen in cross section.

The FIGS. 2 and 3 each show a part of the different embodiments of a watermark bar code 3 from FIG. 1 according to line AA upon viewing in transmitted light. In both cases and also in the examples explained in the following, the bar code is a digital bar code consisting of zeros and ones, the width of the bar indicating the value "0" or "1". The bars 5 are separated from each other by separating fields 6, the first and the last separating field defining the boundaries of the bar code. The bar codes shown in FIGS. 2 and 3 thus each read 0-1-1-0.

With the embodiment according to FIG. 2 the separating fields 6 appear dark compared to the bars 5. That means, in the areas of the separating fields 6 the bank note has an increased fiber density, which has been produced by a respective embossing of the papermaking screen used for manufacturing of bank note paper. This embossing of the papermaking screen causes an increased deposit of paper fiber during the papermaking, by means of which the transmitted light intensity, when the paper is viewed in transmitted light, is decreased respectively and the separating fields 6 appear dark. The bars 5, which define the actual information of the bar code, in transmitted light appear neither lighter nor darker than the bank note material surrounding the bar code, since the bars 5 do not have any watermark characteristics. Since due to this fact not the information-conveying bars 5 but the separating fields 6 are detected by means of a bar code reader, the width of the information-conveying bars is determined merely indirectly via the distance between the detected separating fields 6.

The same applies to the embodiment shown in FIG. 3, in which, deviating from the embodiment according to FIG. 2, the separating fields 6 of the bar code appear light, except for the separating field on the extreme left. The light separating fields 6 can be produced particularly strikingly by using so-called electrotypes. Electrotypes, in general, are small metal parts, which are fixed on one side of the papermaking screen, for example soldered or by means of brackets which are put into the mesh of the screen and bent over. With that very narrow and particularly light transmitted light effects can be obtained, which are easily to detect by sensors.

The extreme left separating field 6 in FIG. 3 defines that the following broad bars are to be counted as "0" and the narrow bars 5 as "1", as it is the case in FIG. 2. If the extreme left separating field 6 would be formed as a light separating field, like all other separating fields 6, then the information content of the bars 5 would be the other way round and the whole information of the bar code would not read 0-1-1-0 but 1-0-0-1.

Instead of the characteristic transmitted light intensity or fiber density of the extreme left separating field 6—it could also be the extreme right separating field 6—also the width of the separating field could be related to, so as to indicate the information content of the broad and narrow bars 5. The two possibilities can also be combined, in particular as to define further information of the bar code.

Alternatively or additionally, also the first or the last bar 5 can serve as a startbit or endbit, for example, the width of the startbit bar or endbit bar giving information on whether the broad bars are counted as "0" and the narrow bars as "1" or vice versa.

Figure 4:
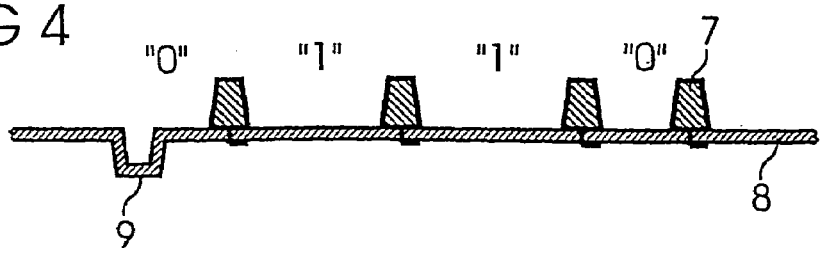

In FIG. 4 by way of example and only schematically is shown a part of a papermaking screen 8, with which a paper with a watermark bar code according to FIG. 3 can be manufactured. For that the papermaking screen 8 has electrotypes 7 appropriately spaced-apart on its papermaking surface for producing the light separating fields 6, as well as a deep-embossed area 9 for producing the extreme left separating field 6 that has an increased paper thickness or fiber density and therefore appears dark in transmitted light.

Figure 5:
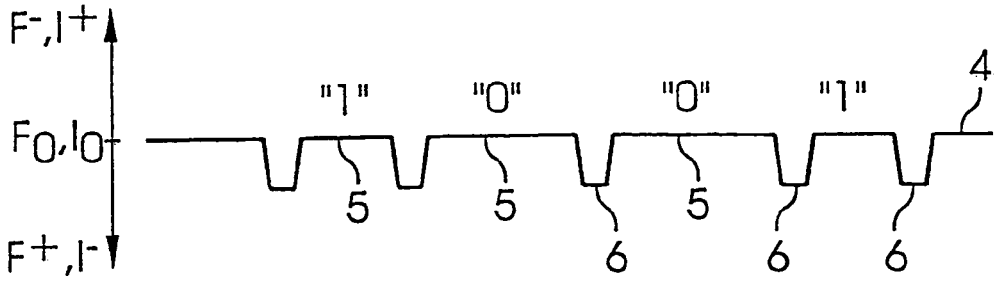
FIG. 5 shows a transmitted light intensity curve according to a first embodiment of an inventive watermark bar code.

FIG. 5 shows an idealized course of the transmitted light intensity of a bar code similar to that shown in FIG. 2 with dark separating fields 6 and with information-conveying bars 5. The transmitted light intensity I in the areas of the separating fields 6 lies below a normal transmitted light intensity $I_0$ of bank note paper, since the fiber density F in the areas of the separating fields 6 is respectively high. The transmitted light intensity curve I thus coincides with the fiber density curve F, if the intensity increase $I^+$ is plotted upwards and the fiber density increase $F^+$ downwards. Transmitted light intensity curve and fiber density curve therefore are both described with reference number 4.

Figure 6:
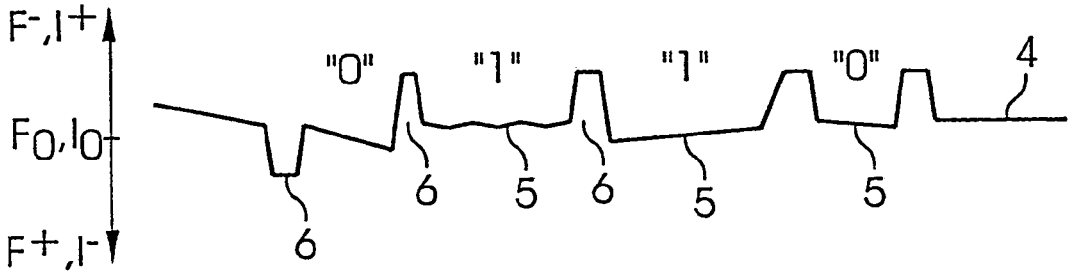
FIG. 6 shows a transmitted light intensity curve according to a second embodiment of an inventive watermark bar code.

FIG. 6 shows the curves of the transmitted light intensity and the fiber density 4 for a bar code similar to that shown in FIG. 3. In this case the transmitted light intensities I in the areas of the separating fields 6 lie above the normal transmitted light intensity $I_0$, except for the extreme left separating field 6, the transmitted light intensity I of which lies below the normal transmitted light intensity $I_0$. In contrast to the description according to FIG. 5 the transmitted light intensity curve in FIG. 6 is shown in a less idealized fashion, as a result of which it becomes apparent, that the transmitted light intensity or fiber density, despite of its in general regular distribution $I_0$, $F_0$ along the extend of the bar 5 of the bar code, slightly varies about an average value $I_0$ or $F_0$, which indicates the "normal transmitted light intensity" and "general fiber density".

Figure 7:
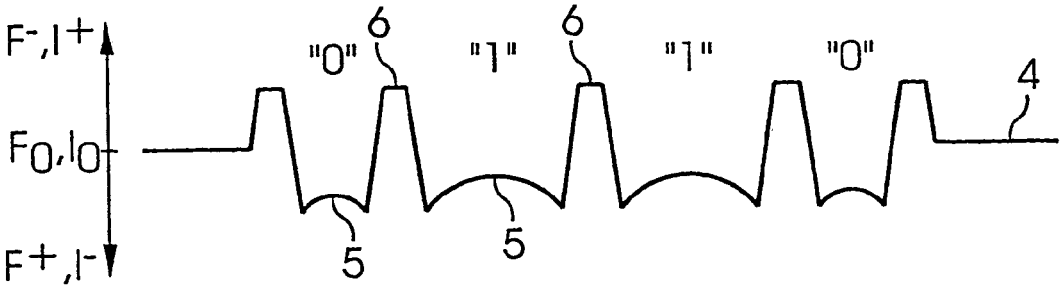
FIG. 7 shows a transmitted light intensity curve according to a third embodiment of an inventive watermark bar code.

In FIG. 7 a further embodiment of the invention is shown. Basically it is a combination of the prior art according to FIG. 9 and the embodiment according to FIG. 6 or FIG. 3. That means, the separating fields 6 as well as the bars 5 are integrated in the paper in the fashion of a watermark, the information-conveying bars 5 in transmitted light appearing as dark areas with somewhat lighter centers, at the outset described as disadvantageous, and the separating fields 6 appearing as strikingly light lines easily to identify. The particularly high transmitted light intensity in the areas of the separating fields 6 exceeds the transmitted light intensity in the lighter center areas of the information-conveying bars 5 in such a way, that a misinterpretation, as explained at the outset, can be ruled out. The embodiment according to FIG. 7 compared to the embodiments according to the FIGS. 5 and 6 or 2 and 3 offers an additional increase of contrast between the areas of the bars 5 and the separating fields 6 and thus an improved readability of the bar code.

The invention claimed is:

1. Security paper with a general fiber density ($F_o$) for manufacturing a document of value or security document, comprising a bar code including information-conveying bars separated from each other by separating fields, characterized in that the separating fields are incorporated as a watermark in the security paper, so that a fiber density of the security paper in an area of these separating fields deviates from a general fiber density of the security paper.

2. Security paper according to claim 1, wherein the fiber density of the security paper in the areas of the information-conveying bars deviates in a different positive or negative direction from the general fiber density as compared to the areas of the separating fields.

3. Security paper according to claim 2, wherein the fiber density of the security paper in the areas of the information-conveying bars is higher and in the areas of the separating fields lower than the general fiber density.

4. Security paper according to claim 1, wherein the fiber density of the security paper in the areas of the information-conveying bars corresponds to the general fiber density.

5. Security paper according to claim 1, wherein the separating fields are more narrow than the information-conveying bars.

6. Security paper according to claim 1, wherein the security paper when viewed in transmitted light at least in one of the separating fields appears lighter than in an area of the security paper with the general fiber density, and at least in one of the other separating fields appears darker than in an area of the security paper with the general fiber density.

7. Security paper according to claim 1, wherein an information-conveying bar located at a boundary of the bar code has a characteristic property as to indicate, which information content is assigned to each of the various bars of different width of the bar code.

8. Security paper according to claim 7, wherein the characteristic property is at least one of width and fiber density of the bar located at the boundary.

9. Security paper according to claim 1, wherein the bar code is a two-dimensional bar code.

10. Security document or document of value comprising a security paper according to claim 1.

11. Security document or document of value according to claim 10, selected from the group of documents: bank note, check, share, identity card, ticket for public transport, admission ticket.

12. Security document or document of value according to claim 10, characterized in that the document has an additional storage medium.

13. The security document or document of value of claim 12 wherein said additional storage medium is an area for magnetic storage of information or a microchip.

14. Method according to claim 1, wherein the papermaking screen at least in the area of one of the separating fields is equipped with an electrotype, so that the deposit of fibers is influenced negatively.

15. Security paper according to claim 1, characterized in that it has an additional storage medium.

16. The security paper of claim 15 wherein said additional storage medium is an area for magnetic storage of information or a microchip.

17. The security paper of claim 1 wherein said document of value or security document is a bank note, check, share, identity card, ticket for public transport or admission ticket.

18. Method for manufacturing a security paper with a general fiber density for a security document or document of value, with a bar code including information-conveying bars separated from each other by separating fields, wherein the security paper in areas of the separating fields is produced as a watermark with a fiber density deviating from a general fiber density of the security paper.

19. Method according to claim 18 using a papermaking screen, which is formed in a special way in the areas of the separating fields, so that in this areas the deposit of fibers for producing a watermark is influenced positively or negatively in the security paper to be manufactured.

20. Method according to claim 19, wherein the papermaking screen in the areas of the information-conveying bars is formed in such a way that in these areas the deposit of fibers is influenced neither positively nor negatively.

21. Method according to claim 19, wherein the papermaking screen in the areas of the information-conveying bars is embossed in such a way that the deposit of fibers in these areas is influenced positively.

22. Method according to claim 18, wherein the papermaking screen at least in the area of one of the separating fields is embossed in such a way that the deposit of fibers is influenced positively.

23. The method of claim 18 wherein said security document or document value is a bank note, check, share, identity card, ticket for public transport or admission ticket.

24. Papermaking screen for manufacturing a security paper with a bar code which includes information-conveying bars separated from each other by separating fields, wherein the papermaking screen has areas for producing the separating fields, in which the papermaking screen is especially formed so as to positively or negatively influence the deposit of fibers in these areas for producing a watermark in a paper to be manufactured with the papermaking screen.

25. Papermaking screen according to claim 24, wherein the papermaking screen in its areas producing the information-conveying bars is formed in such a way, that in these areas the deposit of fibers is not especially influenced and a watermark is not produced in a paper to be manufactured with the papermaking screen.

26. Papermaking screen according to claim 24, wherein the papermaking screen in its areas producing the information-conveying bars is embossed, so as to positively influence the deposit of fibers in these areas for producing a watermark in a paper to be manufactured with the papermaking screen.

27. Papermaking screen according to claim 24, wherein the papermaking screen is embossed in at least one of its areas producing the separating fields, so as to positively influence the deposit of fibers for producing a watermark in a paper to be manufactured with the papermaking screen.

28. Papermaking screen according to claim 24, wherein the papermaking screen at least in one of its areas producing the separating fields is equipped with an electrotype, so as to negatively influence the deposit of fibers for producing a watermark in a paper to be manufactured with the papermaking screen.

29. Papermaking screen according to claim 24, wherein the areas of the papermaking screen for producing the separating fields are formed more narrow than those areas of the papermaking screen for producing the information-conveying bars.

* * * * *